US005649737A

United States Patent [19]

Behnke

[11] Patent Number: 5,649,737

[45] Date of Patent: Jul. 22, 1997

[54] CHAIR TRAY

[76] Inventor: Fred E. Behnke, 4811 Superior Ave.,, Sheboygan, Wis. 53083

[21] Appl. No.: 552,731

[22] Filed: Nov. 3, 1995

[51] Int. Cl.[6] ..... A47B 39/06; A47B 83/02

[52] U.S. Cl. ..... 297/170; 297/160; 297/188.18; 297/153; 248/229.13; 248/221.11; 248/221.12

[58] Field of Search ..... 297/170, 135, 297/153, 160, 188.18, 188.2; 248/229.13, 229.23, 221.12

[56] References Cited

U.S. PATENT DOCUMENTS

| | | | |
|---|---|---|---|
| 1,185,391 | 5/1916 | Fewler | 297/170 X |
| 1,574,695 | 2/1926 | Riley | 248/229.13 |
| 1,684,347 | 9/1928 | Dobbs | 248/229.13 |
| 2,452,182 | 10/1948 | Clawson | 297/160 X |
| 3,025,103 | 3/1962 | Mohror | 297/170 |
| 3,494,661 | 2/1970 | Leyburn | 297/153 |
| 3,606,846 | 9/1971 | Andrews et al. | 297/170 X |
| 3,731,956 | 5/1973 | Hanley | 248/221.12 X |
| 4,455,008 | 6/1984 | Mackew | 297/188.18 X |
| 4,662,676 | 5/1987 | Havelock | 297/160 |

FOREIGN PATENT DOCUMENTS

| | | | |
|---|---|---|---|
| 1229105 | 9/1960 | France | 297/170 |
| 450326 | 8/1936 | United Kingdom | 248/221.12 |
| 453069 | 9/1936 | United Kingdom | 297/160 |
| 495382 | 11/1938 | United Kingdom | 248/221.11 |

*Primary Examiner*—Peter M. Cuomo
*Assistant Examiner*—Rodney B. White
*Attorney, Agent, or Firm*—Donald Cayen

[57] ABSTRACT

A versatile chair tray has a tray, a block joined to the tray, and a brace pivotally connected to the block. The block is supported on a horizontal portion of a chair arm, and the brace is placed against a vertical portion of the chair arm. Spring clips clamp the tray and block to the chair arm horizontal portion and the brace to the chair arm vertical portion. When the chair tray is not in use, the brace folds against the tray to enable several chair trays to be stacked in a neat and stable pile. In a modified embodiment, mushroom heads on the block and brace engage slots in the chair arm to secure the chair tray to the chair. The chair tray is suitable for use with chairs having many different arm designs.

17 Claims, 3 Drawing Sheets

CHAIR TRAY

BACKGROUND OF THE INVENTION

1. Field of the Invention

This invention pertains to furniture, and more particularly to trays that are removably attachable to chairs.

2. Description of the Prior Art

Various types of products have been developed to support food and beverages on a chair. Examples of such products may be seen in U.S. Pat. Nos. 2,650,651; 3,025,103; 3,233,940; 3,586,368; and 4,003,598.

Although the products of the foregoing patents are generally acceptable for their intended purposes, they nevertheless are not completely satisfactory. The trays of U.S. Pat. Nos. 2,650,651 and 3,586,368, for example, are limited to use with chairs having a particular style and size of wide flat arm. The attachment of the U.S. Pat. No. 3,025,103 requires a particular design for the chair legs. The multi-purpose arm of the U.S. Pat. No. 3,233,940, which is a permanent part of a chair, is too narrow to reliably hold a plate of food. The tray of the U.S. Pat. No. 4,003,598 is limited to use with chairs having double-tube arms. It is thus seen that the prior support products are custom designed to suit only certain chairs.

A further disadvantage of many prior chair related products is their bulkiness. With but few exceptions, the prior products cannot be stored compactly with stacked chairs. In addition, the components that render the prior products bulky also tend to make them undesirably expensive.

Thus, a need exists for improvements in products that are attachable to chairs.

SUMMARY OF THE INVENTION

In accordance with the present invention, a versatile chair tray is provided that can be readily attached to a greater number of different kinds of chairs than prior products. This is accomplished by apparatus that includes a block and a brace that support a tray on a chair arm.

The tray has an upper surface that is generally flat. The block is joined to the tray lower surface. The brace is pivotally connected to the block. The brace is pivotable between a stored position whereat it lies in facing contact with the tray lower surface, and an operative position whereat the brace extends at generally a right angle to the tray lower surface.

When the brace is in the stored position, the chair tray of the invention occupies a minimum of space. It can therefore be stored on the seat of a stacked chair without interfering with stacking. If desired, several chair trays can be stacked on top of each other in a neat and stable pile.

The block is supported on the horizontal portion of an arm of a chair such that the tray is horizontal. The brace is placed against a vertical portion of the chair arm. A first spring clip is used to clamp the back end of the tray and block to the horizontal portion of the chair arm. A second spring clip clamps the free end of the brace to the vertical portion of the chair arm. The chair tray remains firmly in place to support plates, glasses, and other items placed on the tray. The chair tray is capable of being used on practically all known folding and outdoor chairs without difficulty.

When it is desired to remove the chair tray from the chair, it is necessary merely to remove the two spring clips. The brace can then be pivoted to its stored position, and the chair tray can be put away. The spring clips can be stored with the chair tray, or they can be used for other purposes while the chair tray is not in use.

In a modified embodiment of the invention, threaded fasteners rather than spring clips are used to secure the chair tray to the chair. That embodiment is particularly useful when the chair tray is to remain on the chair for an extended time.

In a further modified embodiment, the block has a mushroom head formed on it. A similar mushroom head is formed on the brace. There is a first keyhole slot in the horizontal portion of the chair arm, and another keyhole slot in the vertical portion of the chair arm. The mushroom head on the block engages the slot on the arm horizontal portion, and the mushroom head on the brace engages the slot on the arm vertical portion to secure the chair tray to the chair.

The method and apparatus of the invention, using a brace that is pivotally connected to a block that in turn is joined to a tray, thus combines ease of use with versatility. The chair tray is firmly securable to numerous types of chairs, even though the chairs have different designs for their arms.

Other advantages, benefits, and features of the present invention will become apparent to those skilled in the art upon reading the detailed description of the invention.

DETAILED DESCTIPTION OF THE PREFERRED EMBODIMENT

Figure 2:
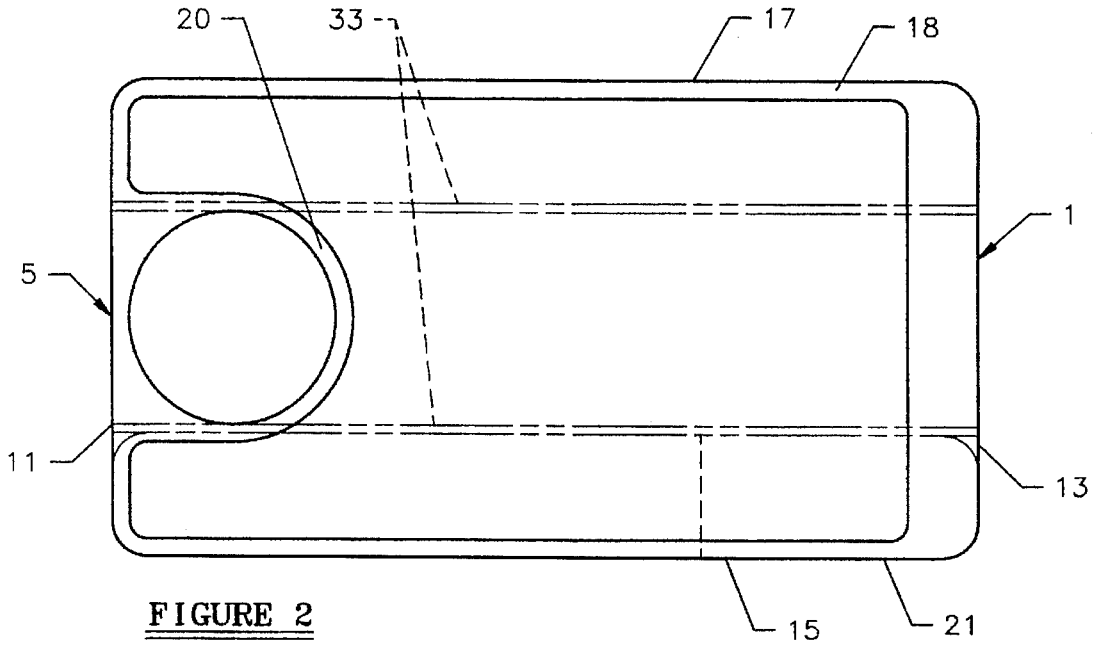
FIG. 2 is a top view of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4, a chair tray 1 is illustrated that includes the present invention. The chair tray 1 is particularly useful for supporting items such as plates of food and beverage containers, not shown, on an outdoor chair 3. However, it will be understood that the invention is not limited to recreational use.

The chair tray 1 is comprised of a flat tray 5 having an upper surface 7 and a lower surface 9. The tray 5 has a front edge 11, a back edge 13, an inside edge 15, and an outside edge 17. As illustrated, a lip 18 extends around the tray edges 11, 13, 15, and 17. The lip 18 has a circular portion 20 near the front edge.

On the lower surface 9 of the tray 5 is a block 19. The block 19 may be a separate piece joined to the tray. The block has an inside edge 21 that preferably is coplanar with the tray inside edge 15, and a back edge 23 that is coplanar with the tray back edge 13. The block has a front edge 25 that is located approximately 30 percent of the distance from the tray back edge to the tray front edge 11.

Figure 1:
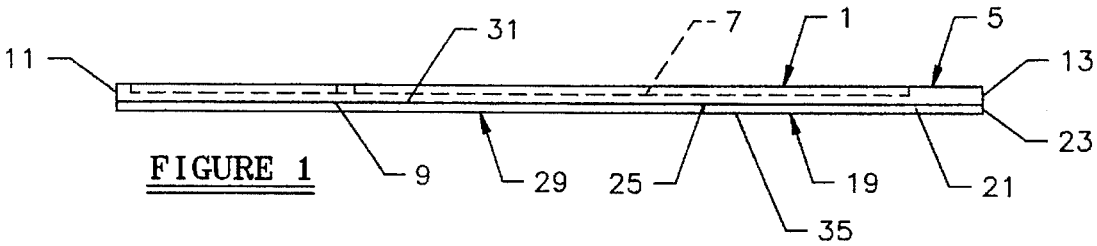
FIG. 1 is a side view of the chair tray of the invention showing the brace thereof in the stored position.
Figure 3:
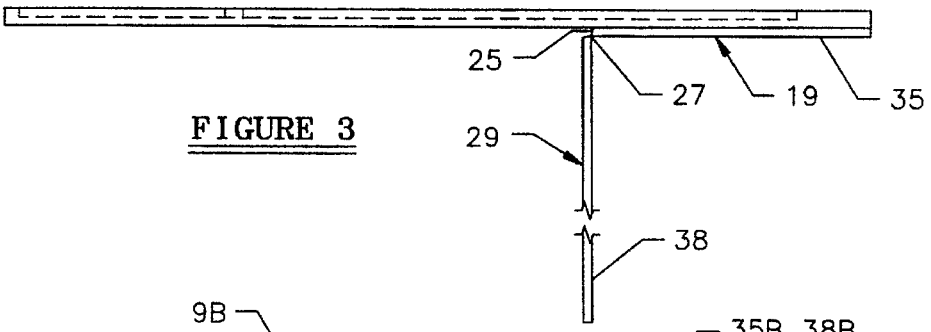
FIG. 3 is a side view of the chair tray showing the brace in the operative position.
Figure 4:
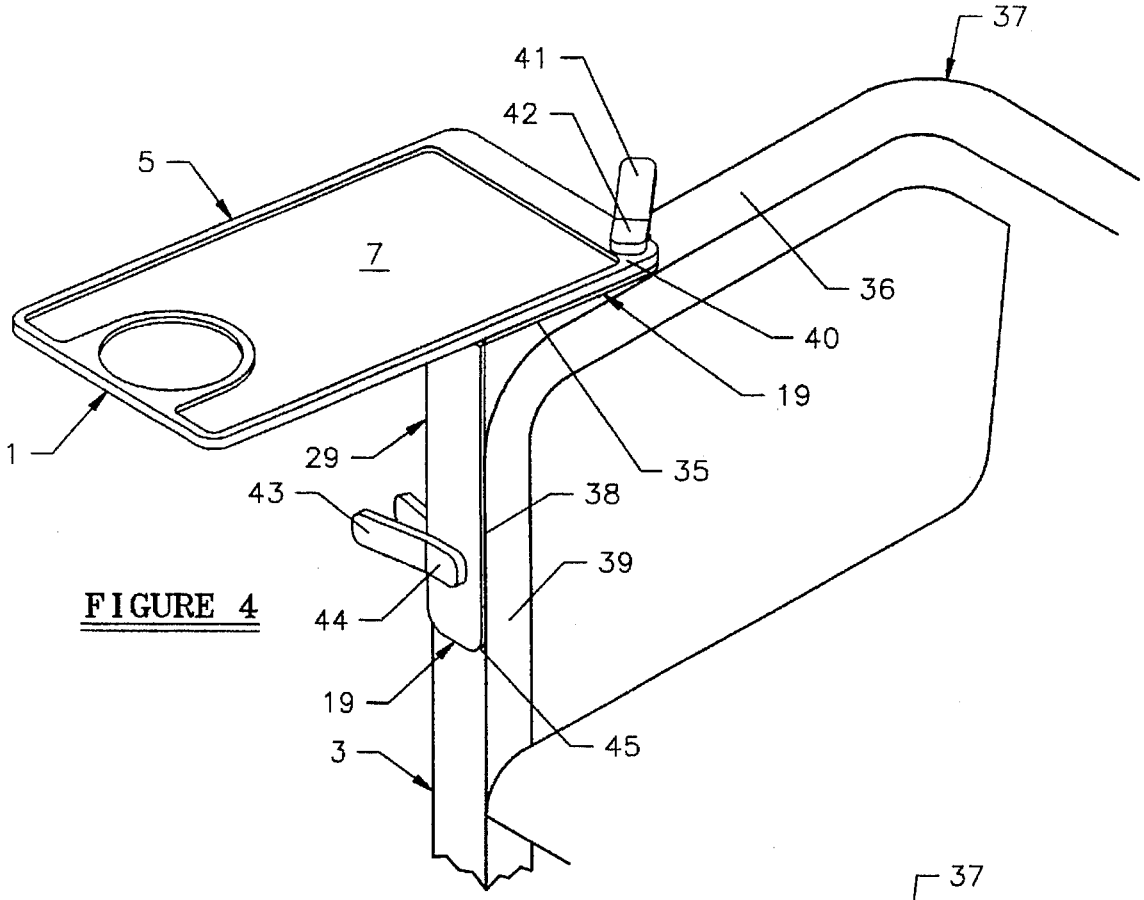
FIG. 4 is a perspective view of the chair tray secured to a typical chair.

Pivotally connected to the front edge 25 of the block 19 is a brace 29. In the illustrated construction, the connection between the block and the brace 29 is a living hinge 27. The living hinge 27 enables the brace to pivot between a stored position as shown in FIGS. 1 and 2, and an operative position as shown in FIGS. 3 and 4. When in the stored position, the brace is parallel to the tray 5, and the brace top surface 31 is in facing contact with the tray lower surface 9. When in the operative position, the brace is approximately 90 degrees to the tray.

I have found that a chair tray 1 made of recycled polypoplene plastic material works very well. Satisfactory dimensions for the tray 5 include a length of approximately 12 inches, a width of approximately eight inches, and a thickness of approximately 0.5 inches. The block 19 may be approximately 0.5 inches thick, four inches long, and two inches wide. The living hinge 27 has a thickness of between approximately 0.03 inches and 0.06 inches. If desired, one or more ribs, typically shown in phantom lines 33 in FIG. 2, can be fabricated on the panel lower surface 9. The ribs 33 would have a thickness approximately equal to that of the block 19 and brace 29.

In use, the bottom surface 35 of the block 19 is supported on the horizontal portion 36 of the arm 37 of the chair 3 such that the tray 5 is horizontal. The brace 19 is pivoted to the operative position, and its bottom surface 38 is placed against the vertical portion 39 of the chair arm 37. The jaws 42 of a first strong spring clip 41 are placed near the common corner 40 of the tray and block. The first spring clip 41 firmly clamps the tray and block to the chair arm horizontal portion 36. The jaws 44 of a second spring clip 43 clamp the brace near its free end 45 to the chair arm vertical portion 39. In that manner, the chair tray 1 is firmly secured to the chair.

The chair tray 1 is very versatile. The flat surfaces 35 and 38 of the block 19 and brace 29, respectively, enable the chair tray to adapt to chairs having numerous designs for their arms. Specifically, the chair tray works just as well with chairs having tubular arms as it does with chairs having flat arms such as those of the chair 3 illustrated in FIG. 4. The pivotable nature of the brace 29 enables its free end 45 to contact the vertical portion of a chair arm even if the arm horizontal portion overhangs the vertical portion. Further, the spring clips adapt to chair arms of different designs without problem. If necessary, the jaws 42 and 44 of the spring clips 41 and 43, respectively, can be curved to clear any bent-over edge of a flat chair arm.

The chair tray 1 is removed from the chair 3 merely by removing the spring clips 41 and 43. The spring clips may be stored with the chair tray, or they may be used for different purposes until the chair tray is again needed for use.

Figure 5:
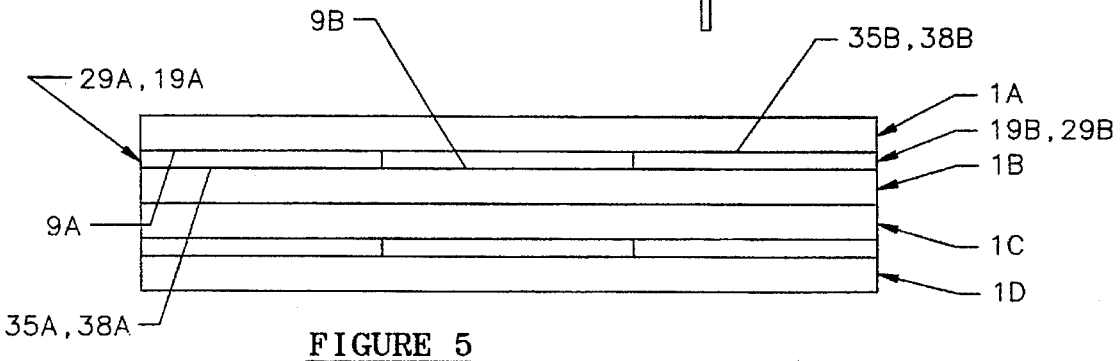
FIG. 5 is an end view on a slightly enlarged scale of several chair tray stacked in a pile.

The beneficial nature of the chair tray 1 is further demonstrated in conjunction with FIG. 5. In FIG. 5, four chair trays 1A, 1B, 1C, and 1D are shown stacked in a neat pile that occupies a minimum of space. The chair trays 1A and 1B are reversed such that the bottom surfaces 35A and 38A of the block 19A and brace 29A, respectively, are against the lower surface 9B of the chair trays 1B, and the bottom surfaces 35B and 38B of the block 19B and brace 29B, respectively, are against the lower surface 9A of the chair tray 1A. Chair trays 1C and 1D are similarly arranged. In that manner, a number of chair trays can be stacked and bundled for stable and compact storage.

Figure 6:
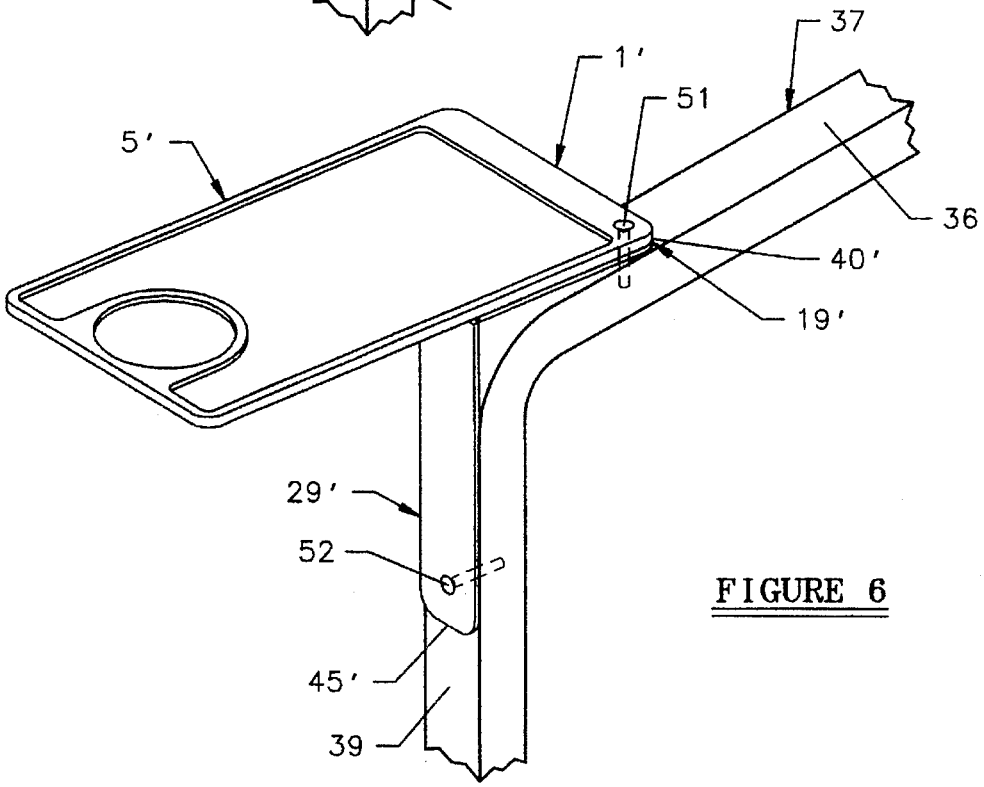
FIG. 6 is a view similar to FIG. 4, but showing a modified embodiment of the invention secured to a chair.

FIG. 6 shows a modified embodiment of the invention. The chair tray 1' of FIG. 6 has a tray 5', block 19', and brace 29' that are generally similar to the corresponding components of the chair tray 1 of FIGS. 1–5. However, a hole is formed through the brace 29' near its free end 45'. A similar hole is formed in the tray 5' and block 19' near their common corner 40'. A screw 51 passes through the hole in the tray 5' and block 19' and is threaded into the horizontal portion 36 of the chair arm 37. A similar screw 52 passes through the hole in the brace 29' and is threaded into the arm vertical portion 39. The chair tray 1' is ideal when it is desired to secure a chair tray to a chair 3 for an extended time.

Figure 7:
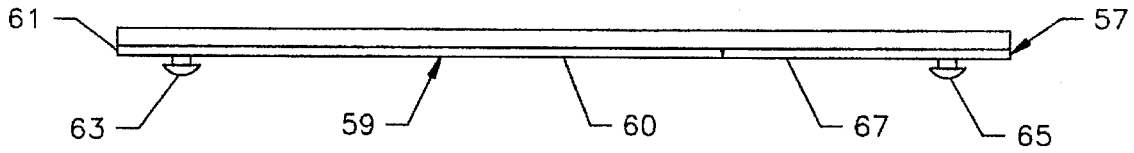
FIG. 7 is side view of a further modified embodiment of the invention.
Figure 8:
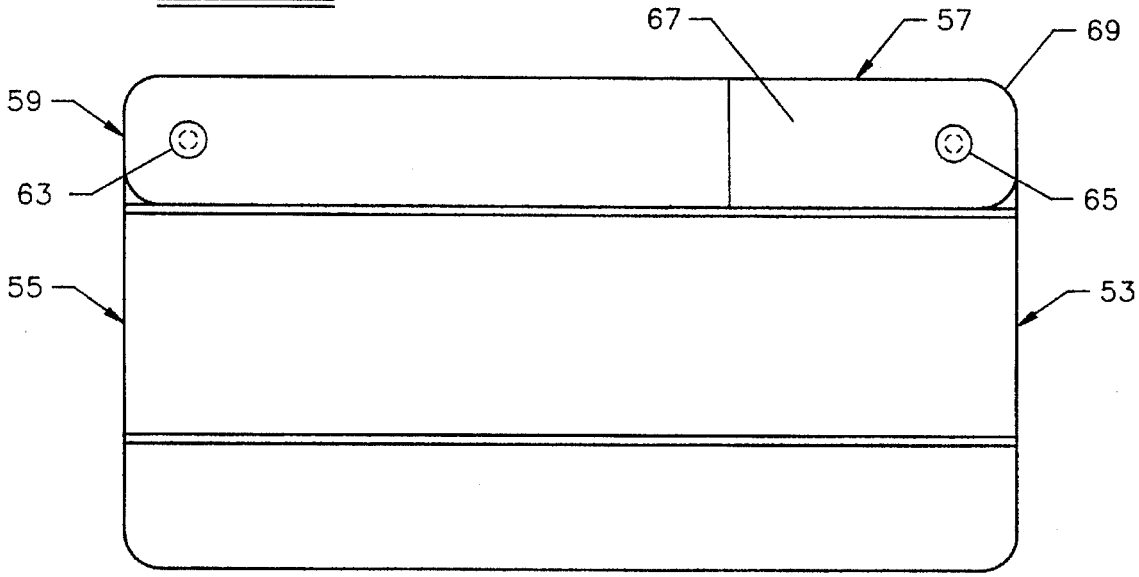
FIG. 8 is a bottom view of FIG. 7.
Figure 9:
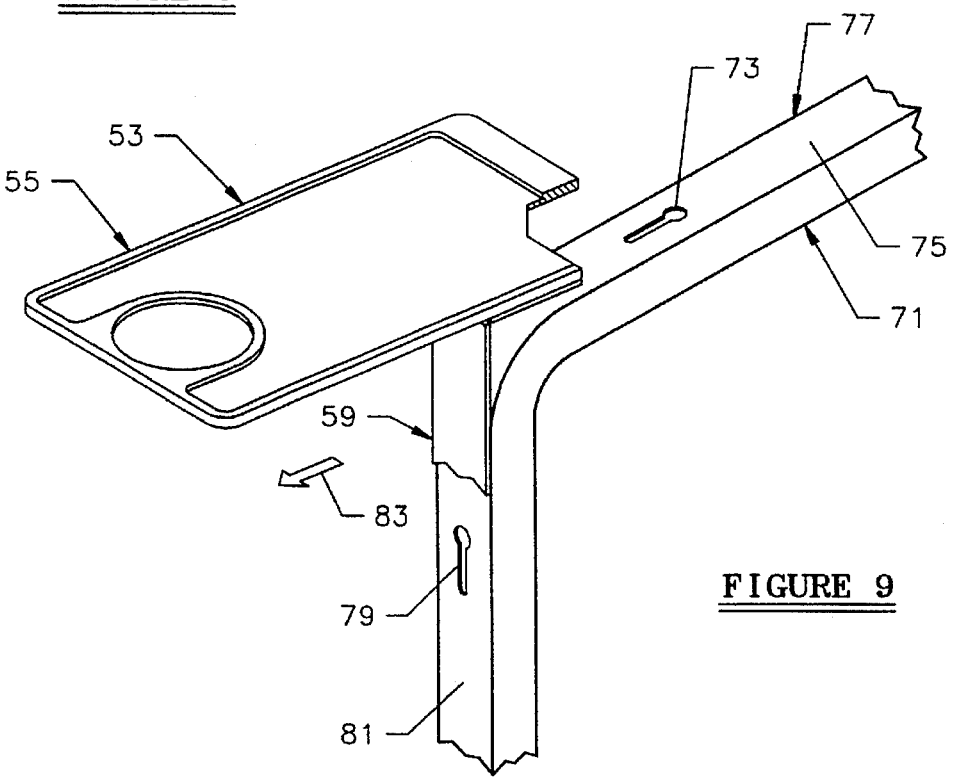
FIG. 9 is a broken perspective view showing the embodiment of FIGS. 7 and 8 secured to a chair.

Now turning to FIGS. 7–9, a further modified chair tray 53 has a tray 55, block 57, and brace 59 that are generally similar to the tray 5, block 19, and brace 29, respectively, of the chair tray 1 of FIGS. 1–5. On the bottom surface 60 and near the free edge 61 of the brace 59 is a mushroom head 63. There is a similar mushroom head 65 on the bottom surface 67 of the block 57 near the common corner 69 of the block and tray 55. The mushroom heads 63 and 65 may be molded integrally with the brace and block, respectively, or they may be separate components embedded in the brace and block.

The chair 71 with which the chair tray 53 is used has a first keyhole slot 73 in the horizontal portion 75 of the arm 77. There is a second keyhole slot 79 in the vertical portion 81 of the chair arm 77.

The chair tray 53 is secured to the chair 71 by inserting the mushroom head 65 in the keyhole slot 73 and the mushroom head 63 in the slot 79. The tray 55 is pushed horizontally fully in the direction of arrow 83, and the brace 59 is pushed fully downwardly. Those actions engage the mushroom heads in their associated slots and thereby secure the chair tray to the chair. Pushing the tray and brace in the reverse direction removes the chair tray from the chair.

In summary, the results and advantages of outdoor chairs can now be more fully realized. The chair tray of the invention provides a temporary but sturdy surface on which to place food and drink items. This desirable result comes from using the combined functions of the pivotable brace and spring clips. The spring clips enable the chair tray to be very quickly secured to and removed from the chair. The brace and spring clip cooperate to enable the chair tray to accommodate numerous designs of chair arms. Because of this simple and clean design, the chair tray possesses the further advantage of being compactly stored. The design of the chair tray that utilizes alternate means for securing it to a chair possesses the same general advantages as the chair tray design that utilizes the spring clips.

It will also be recognized that in addition to the superior performance of the chair tray of the invention, its construction is such as to be of very modest cost. Consequently, it is readily affordable as an important accessory to considerably more expensive outdoor chairs. Also, since the chair tray is made of a simple design and from rugged components, it will give a long service life with little or no maintenance.

Thus, it is apparent that there has been provided, in accordance with the invention, a chair tray that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A chair tray comprising:

a. a generally flat tray;

b. brace means joined to the tray for contacting the chair, wherein the brace means comprises:

i. a block joined to the tray; and ii. a brace pivotally connected only to the block for pivoting between a stored position whereat the brace is in facing contact with the tray and an operative position whereat the brace extends generally at a right angle to the tray;

c. first means for securing the tray and brace means to a chair with the tray being substantially horizontal; and d. second means for securing the brace means to the chair.

2. The chair tray of claim 1 wherein the brace is connected to the block with a living hinge.

3. The chair tray of claim 1 wherein:

a. the tray has upper and lower surfaces and opposed first and second side edges;

b. the block has a first side edge that is coplanar with the first side edge of the tray; and c. the brace has a first side edge that is coplanar with the first side edge of the tray.

4. The chair tray of claim 1 wherein:

a. the tray has first and second ends;

b. the block has a first end that is coplanar with the tray first end; and c. the brace has a free end that is coplanar with the tray second end when the brace is in the stored position.

5. The chair tray of claim 1 wherein:

a. the block is supported on a horizontal portion of a chair arm when the chair tray is secured to the chair; and b. the brace lies generally against a vertical portion of the chair arm when the chair tray is secured to the chair.

6. The chair tray of claim 1 wherein:

a. the first means for securing the tray and brace means to a chair comprises a first mushroom head formed on the block, the first mushroom head securing the block to a horizontal portion of a chair arm; and b. the second means for securing the brace means to the chair comprises a second mushroom head on the brace, the second mushroom head securing the brace to a vertical portion of the chair arm.

7. Apparatus for supporting selected items on a chair having an arm with horizontal and vertical portions comprising:

a. a tray having an upper surface and an unrecessed lower surface;

b. a block joined to the tray lower surface;

c. a brace connected only to the block for pivoting between a stored position whereat the brace is in facing contact with the tray lower surface and an opposite position whereat the brace is approximately 90 degrees to the tray lower surface; and d. means for securing the tray, block, and brace to the chair arm.

8. The apparatus of claim 7 wherein the tray, block, and brace have respective side edges that are coplanar.

9. The apparatus of claim 7 wherein the block is supported on a horizontal portion of the chair arm, and wherein the brace is against a vertical portion of the chair arm.

10. The apparatus of claim 7 wherein the means for securing the tray, block, and brace to the chair comprises:

a. a first clip having jaws that clamp the tray, block, and the horizontal portion of the chair arm therebetween; and b. a second clip having jaws that clamp the brace and the vertical portion of the chair arm therebetween.

11. The apparatus of claim 7 wherein the means for securing the tray, block, and brace to the chair comprises:

a. first head means on the block for engaging a slot on the horizontal portion of the chair arm to secure the block to the chair; and b. second head means on the brace for engaging a slot on the vertical portion of the chair arm to secure the brace to the chair.

12. In combination:

a. a chair having an arm with horizontal and vertical portions;

b. a chair tray comprising:

i. a flat tray having upper and lower surfaces;

ii. a block joined to the tray lower surface and supported on the horizontal portion of the chair arm; and iii. a brace pivotally connected to the block and having a bottom surface placed against the vertical portion of the chair arm; and c. means for securing the chair tray to the chair arm.

13. The combination of claim 12 wherein:

a. the chair arm defines a keyhole slot in each of the horizontal and vertical portions thereof; and b. the means for securing the chair tray to the chair arm comprises:

i. a first mushroom head on the block that engages the keyhole slot in the horizontal portion of the chair arm;

ii. a second mushroom head on the brace that engages the keyhole slot in the vertical portion of the chair arm.

14. The combination of claim 12 wherein the brace is pivotally connected to the block with a living hinge.

15. The combination of claim 12 wherein the means for securing the chair tray to the chair arm comprises:

a. first fastener means for passing through the tray and block and threading into the horizontal portion of the chair arm; and b. second fastener means for passing through the brace and threading into the vertical portion of the chair arm.

16. The combination of claim 12 wherein the means for securing the chair tray to the chair arm comprises:

a. a first clip having first jaws that clamp the tray, block, and the horizontal portion of the chair arm therebetween; and b. a second clip having second jaws that clamp the brace and the vertical portion of the chair arm therebetween.

17. The combination of claim 12 the tray, block, and brace have respective side edges that are coplanar.

* * * * *